US005576140A

United States Patent [19]

Wakata et al.

[11] Patent Number: 5,576,140

[45] Date of Patent: Nov. 19, 1996

[54] IMAGE-RECEIVING SHEET MATERIAL, METHOD FOR FORMING TRANSFER IMAGE AND LAMINATE

[75] Inventors: Yuichi Wakata; Hideyuki Nakamura, both of Shizuoka, Japan

[73] Assignee: Fuji Photo Film Co., Ltd., Kanagawa, Japan

[21] Appl. No.: 612,436

[22] Filed: Mar. 7, 1996

[30] Foreign Application Priority Data

Mar. 7, 1995 [JP] Japan ..... 7-047055

[51] Int. Cl.[6] ..... G03C 8/26; G03C 11/12

[52] U.S. Cl. ..... 430/201; 430/200; 430/263; 430/941; 428/500; 428/522; 503/227

[58] Field of Search ..... 430/200, 201, 430/267, 941; 503/227; 428/500, 522

[56] References Cited

U.S. PATENT DOCUMENTS

| | | | |
|---|---|---|---|
| 3,766,053 | 8/1988 | Shinozaki et al. | 430/263 |
| 5,085,969 | 2/1992 | Namiki et al. | 430/263 |
| 5,232,817 | 8/1993 | Kawakami et al. | 430/200 |
| 5,300,398 | 4/1994 | Kasczuk | 430/200 |

FOREIGN PATENT DOCUMENTS

| | | | |
|---|---|---|---|
| 52-27642 | 3/1977 | Japan | B41M 5/26 |
| 63-82786 | 4/1988 | Japan | B41M 5/26 |
| 5-254256 | 10/1993 | Japan | B41M 5/30 |
| 7-117359 | 5/1995 | Japan | B41M 5/30 |

*Primary Examiner*—Richard L. Schilling
*Attorney, Agent, or Firm*—Sughrue, Mion, Zinn, Macpeak & Seas

[57] ABSTRACT

An image-receiving sheet material for forming a transfer image by heat-transferring an ink layer from a transfer material having a heat-transferable ink layer onto an image-receiving sheet material, and re-transferring the ink layer onto a permanent support. The image-receiving sheet material comprises a support having thereon at least two image-receiving layers, at least one of the image-receiving layers is transferred onto the permanent support, and at least the image-receiving layer onto which the ink layer is transferred contains a modified resin prepared from a polyvinyl acetal resin containing hydroxyl groups in which from 0.1 to 1 equivalent of the hydroxyl groups of the polyvinyl acetal resin have been converted to a group represented by formula (I). In a preferred embodiment, the image-receiving layer onto which the ink layer is transferred further contains a high molecular weight compound having at least a repeating unit represented by formula (II) and/or formula (III). In image forming method using the image-receiving sheet material, and a laminate comprising an image-receiving sheet layer and a heat transferable ink layer are also disclosed.

29 Claims, No Drawings

IMAGE-RECEIVING SHEET MATERIAL, METHOD FOR FORMING TRANSFER IMAGE AND LAMINATE

FIELD OF THE INVENTION

The present invention relates to an image-receiving sheet material for a heat-sensitive transfer recording system. The present invention also relates to an image forming method comprising transferring a heat-sensitive ink layer containing a coloring material onto an image-receiving sheet material using a thermal head or by irradiating with laser beams to form an image, and then re-transferring the ink image onto a permanent support to form a transfer image. The image obtained according to the present invention is of high quality and has excellent printing matter approximation.

BACKGROUND OF THE INVENTION

Recently, as office automation has developed, copying machines or printers using various recording systems such as an electrophotographic system, an ink jet system or a heat transfer recording system have come into use depending on the intended application. A coloring material is used to form an image. Usually, a composition containing a coloring material is melted or a coloring material is evaporated or sublimated to form an image on a recording medium such as a paper or a film sheet by adhesion, adsorption or dyeing.

In particular, a heat-sensitive transfer recording system is advantageous in that operation and maintenance are easy, and the apparatus can be down-sized or reduced in cost. This heat-sensitive transfer recording system has conventionally been known to include the following two types of systems. One type is a heat-fusion type transfer system where a transfer sheet comprising a support having thereon a heat-fusible ink layer is imagewise heated by laser beams or a thermal head to melt-transfer the fusible ink onto an image-receiving sheet for heat-sensitive transfer recording. The other type is a sublimation type dye transfer system where an ink sheet for heat-sensitive transfer recording comprising a support having thereon an ink layer containing a heat-diffusible dye (sublimation dye) is used, and the heat-diffusible dye is diffusion-transferred into an image-receiving sheet for heat-sensitive transfer recording.

The sublimation type dye transfer system is advantageous in that the gradation of an image can be controlled by varying the transfer amount of a dye depending on the change in thermal energy of the thermal head. Therefore, a color image having a continuously variable color density can be obtained by the superimposed recording of cyan, magenta and yellow images. However, this system has the following disadvantages:

(1) Because the image gradation is mainly reproduced by varying the density gradation, the system may satisfy a limited demand in public use where gradation similar to that of a photograph is desired. However, this technique is not suitable for color proofing, for example, in the printing field where the gradation is reproduced by area gradation alone;

(2) Because the image formation is achieved by sublimating a dye, the finished image does not have satisfactory edge sharpness, and the solid density of a thin line is lower than that of a thick line. This gives rise to poor character image quality;

(3) Because the resulting image has low durability, expanded use into product applications requiring good heat durability or light resistance is restricted;

(4) Because its heat-sensitive recording sensitivity is low compared to that of a heat-fusion type transfer method, the sublimation type dye transfer system is not suitable for future high-speed recording applications using a high-resolution thermal head; and (5) A sublimation type dye transfer material is expensive compared to a heat-fusion type transfer material.

On the other hand, a heat-fusion type transfer system is advantageous in that its heat-sensitive sensitivity is high compared to a sublimation type dye transfer system, the light resistance of the resulting image is excellent and the material is inexpensive. However, this system has the following disadvantages.

(1) Because the gradation is reproduced by binary recording without density gradation, the multiple gradation property is inferior;

(2) Because a crystalline wax having a low melting point is usually used as a binder of the ink layer, the resolution is reduced due to bleeding of the wax upon heat printing and the transfer image has low intensity; and (3) If a crystalline wax is used, a transparent image is difficult to obtain due to light scattering of the crystal phase.

Under these circumstances, the present inventors previously proposed a heat adhesion thin film release system as a new type of heat-sensitive recording material. Such a system is capable of providing a pigment color image having a multiple gradation property only using the area gradation of binary recording JP-A-7-117359 (the term "JP-A" as used herein means an unexamined published Japanese patent application). According to this system, a high-quality color image or monochrome image having multiple gradation can be achieved by a pigment transfer method using area gradation alone. This considerably alleviates the problems encountered in a conventional heat-sensitive transfer recording system, and thereby allows for public use as well as expanded use into the printing field for color proofing or as a block copy original. In addition, due to the light resistance of the pigment, this system can be advantageously used in the card field, the outdoor display field or the meter display field.

On the other hand, various transfer materials have been proposed for use in the above-described heat-sensitive transfer recording materials. When plain paper is used in an image-receiving medium of a sublimation type dye transfer system, the dyeing is particularly difficult. As a result, not only is the density of the recorded image low, but there is also a conspicuous discoloration phenomenon caused by aging. Accordingly, a plain paper having provided thereon an image-receiving layer comprising a thermoplastic resin as a main component has been proposed as an image-receiving paper, and various investigations are being conducted to improve recording sensitivity, resolution, sharpness, color density and the like. A plain paper can be used in principle as a transfer material in a heat-fusion type transfer system. However, the use of plain paper is accompanied by uneven transfer, dot falling or the like defect due to smoothness of the transfer surface or ink acceptability. Accordingly, various image-receiving materials are being investigated so as to improve surface smoothness, ink transfer acceptability, fixability, gradation property, sharpness and the like. The support for these image-receiving media uses a material such as a plain paper, a synthetic paper, a synthetic resin film or a white base filled with a white pigment. In this way, the material on which a transfer image is formed is restricted to an exclusive paper or resin sheet having provided thereon an image-receiving layer. Therefore, the quality is unsatisfactory if it is used for proofing which requires printing matter approximation.

A method for transferring a recording image to arbitrary desired supports is also known. JP-A-52-27642 describes a method where a transfer layer is attached by heating to an intermediate receptor, and then the transfer layer thus attached is transferred to a material such as paper. However, this publication does not mention any improvement in image quality.

JP-A-63-82786 describes a technique for selecting a resin or wax as well as a butyral resin contained in the heat transfer layer as a component of the coating film other than a butyral resin. Examples of the resin include a phenol resin, an epoxy resin, a urethane resin, a rosin or polyamide resin and a sulfonamide resin. However, when using the above-described resin, particularly a rosin or polyamide resin, the shadow part vanishes. Furthermore, when a polyamide resin is used, the reproduced gradation property is highly sensitive to changes in temperature and humidity. Another problem is that when the resin is added in a large amount, the surface of the image-receiving layer becomes tacky. This in turn causes an increase in dust flaws or unevenness.

Thus, although various image-receiving sheet materials have hitherto been proposed as a transfer material of a heat-sensitive transfer recording material, none of these has achieved an image having excellent recording sensitivity, dot quality and gradation reproducibility in a heat transfer method using area gradation. In particular, if the heat recording sensitivity is elevated, the heat adhesion temperature of the image-receiving layer is lowered and tackiness tends to increase. This gives rise to a sticking phenomenon due to tackiness or reduced resistance to adhesion of the image upon storage after recording. As a result, the printed matter approximation such as texture reproduction of the printing permanent paper is unsatisfactory, especially for obtaining a high quality color image having multiple gradation such as a color proof for color correction.

Also, investigations have been made on a heat transfer ink layer. For example, JP-A-5-254256 describes the formulation of a toner layer comprising a polyamide resin (nylon) binder and a pigment. However, the high cohesion of the nylon gives rise to poor dot sharpness and gradation reproducibility, or inferior resistance to changes in temperature and humidity.

As discussed above, there has not yet been known an image-receiving material for heat-sensitive transfer recording that is capable of forming a high-quality multiple gradation color image having good recording sensitivity, dot quality (halftone dot quality) and gradation reproducibility (halftone reproducibility), which image receiving material does not exhibit tackiness, sticking and dust flaws, and wherein the change in recording sensitivity to changes in humidity is reduced and the printed matter approximation is excellent.

SUMMARY OF THE INVENTION

An object of the present invention is to provide an image-receiving sheet for heat-sensitive transfer recording capable of achieving a high-quality multiple gradation color image having good recording sensitivity, dot quality and gradation reproducibility, which image receiving sheet is free from tackiness, sticking and dust flaws and is not sensitive to changes in humidity using a heat-transfer method which provides good performance using only area gradation. Furthermore, an object of this invention is to provide a method for forming a transfer image using the above-described image-receiving sheet material.

Another object of the present invention is to provide an image-receiving sheet material for heat-transfer recording which can transfer an image to a printing permanent paper and having excellent printed matter approximation such as texture reproduction of the printing permanent paper and gloss of an image. Furthermore, an object of this invention is to provide a method for forming a transfer image using the image-receiving sheet material.

The above-described objects of the present invention have been achieved by an image-receiving sheet material for use in forming a transfer image by heat-transferring an ink layer from a transfer material having a heat-transferable ink layer onto an image-receiving sheet material and re-transferring the ink layer from the image-receiving sheet onto a permanent support, wherein the image-receiving sheet material comprises a support having thereon at least two image-receiving layers, at least one of the image-receiving layers is transferred onto the permanent support and at least the image-receiving layer onto which the ink layer is transferred comprises a modified polyvinyl acetal resin prepared from a polyvinyl acetal resin containing hydroxy groups in which from 0.1 to 1 equivalent of the hydroxyl groups of the polyvinyl acetal resin have been converted to a group represented by the following formula (I):

$$—O—W \qquad (I)$$

wherein W represents $—CONH—Y^1$, $—COO—Y^2$, $—Y^3$, $—SiY^4Y^5Y^6$, $SO_2Y^7$, $—CO—Z^1—COOH$ or $—COCH_2COMe$, $Y^1$, $Y^2$, $Y^3$, $Y^4$, $Y^5$, Y6 and Y7 each represents a monovalent organic group having from 1 to 20 carbon atoms and $Z^1$ represents a divalent organic group having from 1 to 20 carbon atoms.

DETAILED DESCRIPTION OF THE INVENTION

The present invention is described in detail below.

The support of the image-receiving sheet comprises a flexible, chemically and thermally stable material. The material may transmit actinic rays, if desired. Specific examples of the material include polyolefins such as a biaxially stretched polyethylene terephthalate film, polyethylene and polypropylene, polyvinyl halides such as polyvinyl chloride and polyvinylidene chloride, cellulose derivatives such as cellulose acetate, nitrocellulose and cellophane, polyamides, polystyrene, polycarbonates and polyimides. If desired, a paper laminated with a polyethylene film may also be used. Among these, particularly preferred is biaxially stretched polyethylene terephthalate film having good dimensional stability and transmission, however, the present invention is not limited thereto. The thickness of the support for the image-receiving sheet is generally from 30 to 200 μm.

At least two image-receiving layers are provided on the support. In a preferred embodiment, one of the image-receiving layers is a layer in contact with the support (hereinafter referred to as a first image-receiving layer), and the other layer is provided on the first image-receiving layer (hereinafter referred to as a second image-receiving layer).

In order to increase the adhesive strength between the support and the first image-receiving layer, the support may be subjected to a surface treatment such as a corona discharge treatment or a glow discharge treatment. Alternatively, an undercoat layer may be applied to the support. The composition or type of undercoat layer is not particularly limited as long as it increases the adhesive strength between the support and the first image-receiving layer. However, an undercoat layer comprising a silane coupling agent is particularly preferred.

The first image-receiving layer is described below.

The first image-receiving layer preferably has a modulus of elasticity of 200 kg.f/cm$^2$ or less. By using a polymer layer having a small elasticity modulus, the image-receiving layer is imparted a cushioning property. As a result, the recording sensitivity, the dot quality and the gradation reproducibility are improved. In addition, the cushioning property prevents foreign matter such as dust that may be present between a heat-sensitive recording material and the image-receiving sheet material from generating an image defect. Furthermore, in re-transferring the image transferred to the image-receiving sheet material onto a printing permanent support such as paper under application of heat and pressure, the first image-receiving layer conforms to irregularities of the paper. As a result, the second image-receiving layer and the ink layer are adhered to the paper with conforming to the irregularities of the paper, to thereby achieve good adhesion. Therefore, even if the surface of the second image-receiving layer is not subjected to a treatment such as matting after release of the first image-receiving layer, an image having a surface gloss which approximates a printed matter can be obtained.

Specific examples of the resin composition of the first image-receiving layer include a polyolefin such as polyethylene and polypropylene; an ethylene copolymer such as an ethylene and vinyl acetate copolymer and an ethylene and acrylic ester copolymer; a polyvinyl chloride; a vinyl chloride copolymer such as a vinyl chloride and vinyl acetate copolymer; a polyvinylidene chloride; a vinylidene chloride copolymer; a polymethacrylate; a polyamide resin such as a copolymer of nylon and N-alkoxymethylated nylon; a synthetic rubber; and rubber chloride, and at least one is preferably selected from the above-described organic polymer materials. Among these, particularly preferred are a polyvinyl chloride, a vinyl chloride and vinyl acetate copolymer, a vinyl chloride and vinyl alcohol copolymer and a vinyl chloride, vinyl acetate and a maleic acid copolymer, each having a polymerization degree of from 200 to 2,000. This is because polyvinyl chloride and the vinyl chloride copolymer (1) each exhibits almost no tackiness at room temperature, (2) each has a relatively low modulus of elasticity to facilitate conformance to irregularities of the transfer image upon heat transferring, (3) it is easy to control the modulus of elasticity due to the availability of an abundance of plasticizers having good compatibility with the resins and (4) it is easy to control the interlayer adhesive strength due to the presence of a hydroxyl group or a carboxyl group in the copolymer components. It is of course possible to add various other polymers, adhesion improving agents, surface active agents or releasing agents so as to adjust the adhesive strength of the first image-receiving layer to the image-receiving sheet support or to the second image-receiving layer. Also, addition of a tacky polymer is very useful for lowering the modulus of elasticity within a range such that the first image-receiving layer does not become tacky at room temperature.

For example, a fluorine-based surface active agent may be added to one or more of the image-receiving layers to reduce the interlayer adhesive strength. At the same time, the wettability between the heat transferable ink layer and the image-receiving layer surface is improved to provide a good dot shape. However, if the addition amount of the fluorine-based surface active agent is excessive, the adhesive strength between the heat transferable ink layer and the image-receiving layer surface is reduced to thereby degrade the dot shape. Accordingly, the releasing agent or the surface active agent is preferably added to the image-receiving layer in an amount of from 0.0001 to 5 wt %, more preferably from 0.001 to 3 wt %. In order to optimize the properties of the coating surface, the surface active agent is preferably added to the image-receiving layer in a small amount.

When a vinyl chloride-based resin is used as the resin of the image-receiving layer, it is also effective to add an organotin-based stabilizer such as a butyltin-based stabilizer or an octyltin-based stabilizer which is well known in the art as a stabilizer for polyvinyl chloride or a vinyl chloride copolymer.

The thickness of the first image-receiving layer is preferably from 1 to 50 μm, more preferably from 5 to 30 μm. Namely, when an image that has been transferred onto the image-receiving sheet material is then transferred to a permanent support, the thickness of the first image-receiving layer must be larger than the irregularities on the surface of the permanent support. Also, the thickness of the first image-receiving layer must be large enough to sufficiently absorb the difference in relief height on portions where four colors are superimposed thereon. Furthermore, the thickness of the first image-receiving layer must be large enough to provide a satisfactory cushioning property.

The second image-receiving layer provided on the first image-receiving layer is described below. The second image-receiving layer is provided so that when the image-receiving sheet is peeled off upon re-transferring to the permanent support, an interlayer release can take place between the first image-receiving layer and the second image-receiving layer. This leaves only the thin second image-receiving layer on the image transferred to the permanent support, to thereby provide an image having a gloss which approximates a practical printed matter due to irregularities of the permanent support and without the need for applying a special matting treatment thereto. The second image-receiving layer also improves the flaw resistance of the image. Accordingly, as long as the above-described effects can be provided, the second image-receiving layer may be formed of a laminate comprising two or more layers.

The second image-receiving layer comprises a modified polyvinyl acetal resin prepared from a polyvinyl acetal resin containing hydroxyl groups in which from 0.1 to 1 equivalent of the hydroxyl groups in the polyvinyl acetal resin have been converted to a group represented by the following formula (I) (hereinafter referred to as a modified polyvinyl acetal resin):

$$-O-W \qquad (I)$$

wherein W represents $-CONH-Y^1$, $-COO-Y^2$, $-Y^3$, $-SiY^4Y^5Y^6$, $SO_2Y^7$, $-CO-Z^1-COOH$ or $-COCH_2COMe$; $Y^1$, $Y^2$, $Y^3$, $Y^4$, $Y^5$, $Y^6$ and $Y^7$ each represents a monovalent organic group having from 1 to 20 carbon atoms; and $Z^1$ represents a divalent organic group having from 1 to 20 carbon atoms.

Each of $Y^1$, $Y^2$, $Y^3$, $Y^4$, $Y^5$, $Y^6$ and $Y^7$ is not particularly limited as long as it is a monovalent organic group having from 1 to 20 carbon atoms. Specific examples thereof include methyl, ethyl, n-propyl, i-propyl, n-butyl, i-butyl, sec-butyl, t-butyl, amyl, n-hexyl, 2-ethylhexyl, decyl, octadecyl, cyclohexyl, vinyl, allyl, 2-methoxyethyl, 2-ethoxyethyl, 2-methoxypropyl, 2-chloroethyl, trichloroethyl, methoxyethoxyethyl, cyanoethyl, 2-aminocarbonylethyl, benzyl, phenetyl, methoxybenzyl, α-methylbenzyl, phenyl, naphthyl, methoxyphenyl, fluorophenyl, tolyl, styryl, trifluoromethylphenyl vinylbenzyl, 3-butoxy-2-hydroxypropyl, 3-chloro-2-hydroxypropyl and acetylmethyl. Furthermore, the monovalent organic group may be substituted by a halogen atom, an alkoxy group, a cyano group, a nitro group, an ester group or an acyl group.

$Z^1$ is not particularly limited as long as it is a divalent organic group having from 1 to 20 carbon atoms. Specific examples thereof include ethylene, propylene, vinylene, phenylene, cyclohexylene and cyclohexelene. Furthermore, the divalent organic group may be substituted by a halogen atom, an alkoxy group, a cyano group, a nitro group, an ester group or an acyl group.

A polyvinyl acetal resin containing hydroxyl groups which have been converted in whole or part into another functional group for use in a heat transfer material as an adduct of a polyvinyl acetal resin and an isocyanate is described, for example, in JP-A-61-14983, JP-A-61-14991, JP-A-61-14992 and JP-A-62-259889. However, the isocyanates described therein are polyfunctional isocyanates. Therefore, the resin described therein differs from the polyvinyl acetal resin of this invention resin modified by the group represented by formula (I). Another difference is that the resin in the above publications is provided on the surface of a support which does not have a heat transfer layer. JP-A-61-211094 describes the use of the reaction product of a butyral resin with a crosslinking agent. However, this is different from the resin converted to the group represented by formula (I) of the present invention. Furthermore, the resin in this publication is used as the resin of an ink layer in contrast to the present invention.

The modified polyvinyl acetal resin of the present invention can be synthesized by subjecting a polyvinyl acetal resin to a polymer reaction in an appropriate solvent with a compound having a suitable functional group and, if desired, in the presence of a reaction catalyst. The polyvinyl acetal resin is a resin obtained by acetalizing, for example, a polyvinyl alcohol with at least one aldehyde, and specific examples thereof include copolymer acetals such as polyvinyl acetal, polyvinyl formal, polyvinyl butyral, a partially formalated polyvinyl butyral and polyvinyl butyral acetal. These polyvinyl acetal resin generally contains a monomer unit other than the vinyl acetal unit. Specifically, it generally contains therein a vinyl alcohol unit, which remains after the acetalization reaction, generally in an amount of 5 to 40% by weight, and a vinyl acetate unit, which remains after the preparation of the polyvinyl alcohol from polyvinyl acetate by hydrolysis, generally in an amount of not less than 20%. The polyvinyl acetal resin is commercially available, and examples thereof include Denkabutyral #2000L, #3000-1, #3000-K, #4000-1, #5000-A, #6000-C Denkaformal #20, #100, #200 (all produced by Denki Kagaku Kogyo K.K.), S-LEK B Series BL-1, BL-2, BL-S, BM-1, BM-2, BH-1, BX-1, BX-10, BL-1, BL-SH, BX-L and S-LEK K Series KS-10 (all produced by Sekisui Chemical Co., Ltd.).

The polyvinyl acetal resin has an acetalization degree of preferably from about 50 to 85 mol %, more preferably from about 60 to 80 mol %. If the acetalization degree is less than 50 mol %, the solubility of the raw material resin is poor, whereas it is theoretically difficult to synthesize resins having an acetalization degree exceeding 85 mol %. The polymerization degree is preferably from about 50 to 2,000, more preferably from 100 to 1,000. Resins having a polymerization degree of less than 50 are difficult to synthesize, whereas those having a polymerization degree exceeding 2,000 have poor solubility. Examples of useful solvents include acetone, methyl ethyl ketone, tetrahydrofuran, N,N-dimethylformamido, N,N-dimethylacetamido, chloroform, ethyl acetate, methoxypropyl acetate, diethyl ether and dioxane.

A method for synthesizing the modified polyvinyl acetal resin of the present invention is described below for various types of functional group.

The modified polyvinyl acetal resin in which from 0.1 to 1 equivalent of the hydroxyl groups of the polyvinyl acetal resin have been converted into a urethane group (—OCONH—$Y^1$) can be obtained, for example, by the addition reaction of a polyvinyl acetal with a monofunctional isocyanate. Specific examples of the monofunctional isocyanate include ethyl isocyanate, n-propyl isocyanate, i-propyl isocyanate, butyl isocyanate, octadecyl isocyanate, cyclohexyl isocyanate, phenyl isocyanate, 3-i-propenylcumyl isocyanate, 4-methoxyphenyl isocyanate, 2-fluorophenyl isocyanate, m-tolyl isocyanate, p-tolyl isocyanate, 2-trifluoromethylphenyl isocyanate, 1-naphthyl isocyanate and α-methylbenzyl isocyanate. In this reaction, the use of a tin catalyst such as dibutyltin diacetate is effective. The reaction temperature is preferably from room temperature to about 80° C.

The modified polyvinyl acetal resin of the present invention in which from 0.1 to 1 equivalent of the hydroxyl groups of the polyvinyl acetal resin have been converted into a carbonate group (—OCOO—$Y^2$) can be obtained, for example, by the reaction of a polyvinyl acetal resin with a haloformate. Specific examples of the haloformate include methyl chloroformate, ethyl chloroformate, allyl chloroformate, n-propyl chloroformate, butyl chloroformate, amyl chloroformate, hexyl chloroformate, 2-ethylhexyl chloroformate, 2-chloroethyl chloroformate, 2-methoxyethyl chloroformate, phenyl chloroformate and 2-naphthyl chloroformate. In this reaction, a base such as triethylamine, pyridine or sodium hydroxide is preferably added to the reaction mixture. The reaction temperature is preferably from 0° to about 40° C.

The modified polyvinyl acetal resin of the present invention in which from 0.1 to 1 equivalent of the hydroxyl groups of the polyvinyl acetal resin have been converted into an ether group (—$OY^3$) can be obtained, for example, by the reaction of a polyvinyl acetal resin or a metal alcoholate of the resin with an organic halide. Specific examples of the organic halide include methyl iodide, ethyl iodide, benzyl bromide and benzyl chloride. In this reaction, the use of sodium hydroxide, potassium hydroxide or sodium hydride is effective. The reaction temperature is preferably from room temperature to about 120° C. This resin can also be obtained by the addition reaction of a polyvinyl acetal resin with an α,β-unsaturated compound such as acrylonitrile or with an epoxy compound. In this reaction, the use of sodium hydroxide, potassium hydroxide, triethylamine or triethylbenzyl ammonium chloride is effective. The reaction temperature is preferably from room temperature to about 100° C.

The modified polyvinyl acetal resin of the present invention in which from 0.1 to 1 equivalent of the hydroxyl groups of the polyvinyl acetal resin have been converted into a silyl ether group (—$OSiY^4Y^5Y^6$) can be obtained, for example, by the dehydrohalogenation reaction of a polyvinyl acetal resin with a silane halogenide. Specific examples of the silane halogenide include trimethylsilyl chloride and t-butyldimethylsilyl chloride. In this reaction, the use of sodium hydroxide, potassium hydroxide, triethylamine or pyridine is preferred. The reaction temperature is preferably from 0° to about 40° C.

The modified polyvinyl acetal resin of the present invention in which from 0.1 to 1 equivalent of the hydroxyl groups of the polyvinylacetal resin have been converted into a dibasic acid half ester group (—OCO—$Z^1$—COOH) can be obtained, for example, by the addition reaction of a polyvinyl acetal resin with a dibasic acid anhydride. Specific examples of the dibasic acid anhydride include succinic anhydride, maleic anhydride, glutaric anhydride, phthalic anhydride, cyclohexanedicarboxylic anhydride and cyclohexenedicarboxylic anhydride. In this reaction, trimethylamine, pyridine or dimethylaminopyridine is preferably used. The reaction temperature is preferably from room temperature to about 100° C.

The modified polyvinyl acetal resin of the present invention in which from 0.1 to 1 equivalent of the hydroxyl groups of the polyvinyl acetal resin have been converted into an acetoacetate group (—$OCOCH_2COMe$) can be obtained, for example, by the addition reaction of a polyvinyl acetal resin with a diketene. In this reaction, sodium acetate or imidazole is preferably used. The reaction temperature is preferably from room temperature to about 80° C.

The modification ratio of the modified polyvinyl acetal resin of the present invention (the equivalents of a functional group for conversion from a hydroxyl group in the polyvinyl acetal resin raw material) is preferably from 0.1 to 1 equivalents, more preferably from 0.2 to 1 equivalents. In the present invention, one equivalent represents the entire hydroxyl group content of the polyvinyl acetal resin raw material. If it is less than 0.1 equivalents, the change in recording sensitivity to changes in humidity is large. In these reactions, it is also possible to use the reaction reagent in an amount of one or more equivalents based on the hydroxyl group content of the polyvinyl acetal resin raw material so as to effectively proceed with the reaction. In this case, after the reaction has been completed, the excess reagent may remain within a range such that there is no adverse effect on performance, or the excess reagent may be removed by purification, if desired. Furthermore, because the polyvinyl acetal resin usually contains some water, a reaction product with water may be present. A reaction product with water may remain within a range such that there is no adverse effect on performance, or the reaction product with water may be removed by purification, if desired. Or, dehydration treatment may be applied during or before the reaction. The modified polyvinyl acetal resin of this invention may be used alone or in a combination of two or more kinds of modified polyvinyl acetal resins. The content of the modified polyvinyl acetal resin is based on the total solid content of the second image-receiving layer, and is preferably 40 wt % or more, more preferably 50 wt % or more, still more preferably 60 wt % or more.

Also, a high molecular weight compound having a repeating unit represented by the following formula (II) and/or formula (II) is preferably used in combination with the modified polyvinyl acetal resin of this invention:

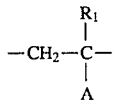

(II)

-continued

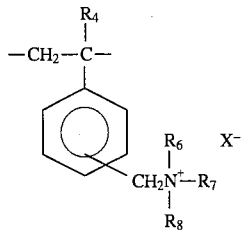

(III)

wherein $R_1$ represents a hydrogen atom or a methyl group, A represents a substituent having an amide bond or a nitrogen-containing heterocyclic ring, $R_4$ represents a hydrogen atom or a methyl group, $R_6$, $R_7$ and $R_8$, which may the same or different, each represents an alkyl group having from 1 to 25 carbon atoms, an aralkyl group having from 7 to 25 carbon atoms or an aryl group having from 6 to 25 carbon atoms (the alkyl group, the aralkyl group or the aryl group may be substituted by a hydroxy group, an alkoxy group having from 1 to 6 carbon atoms, a halogen, a cyano group or a combination of two or more of these groups, either directly of via an ether bond, —OCO—, —COO— or a combination of two or more of these groups) and X represents Cl, Br or I).

The high molecular weight compound having a repeating unit represented by formula (II) and/or (III) can be obtained by polymerizing a monomer represented by the following formula (IV) and/or (V) in a manner known to those of ordinary skill in an appropriate solvent, or using no solvent but in the presence of a polymerization initiator, or by copolymerizing the monomers represented by formulae (IV) and/or (V) with other monomers:

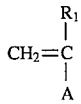

(IV)

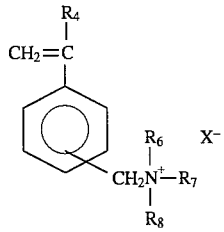

(V)

(wherein $R_1$, A, $R_4$, $R_6$, $R_7$, $R_8$ and X each has the same meaning as defined in formulae (II) and (III)).

In the case where A of formula (IV) is a substituent having an amide bond, A represents $CONHR_2$ or $CONR_2R_3$, wherein $R_2$ and $R_3$ each independently represents a hydrogen atom, an alkyl group having from 1 to 18 carbon atoms or an aryl group having from 6 to 20 carbon atoms (the alkyl group or the aryl group may be substituted with at least one of a hydroxyl group, an alkoxy group having from 1 to 6 carbon atoms, a halogen and a cyano group or a combination of two or more of these groups) or $R_2$ and $R_3$ may be combined to form an alkylene or aralkylene having from to 20 carbon atoms (the alkylene and the aralkylene each may be branched or may have an ether bond, —OCO—, —COO— or a combination of two or more of these groups). In the case when A is a nitrogen-containing heterocyclic ring, A represents an imidazole, a pyrrolidone, a pyridine or a carbazole, which groups each may be substituted by an alkyl group having from 1 to 5 carbon atoms, an aryl group having from 6 to 10 carbon atoms, a halogen, a cyano group or a combination of two or more of these groups.

In a preferred embodiment, when A of formula (IV) is a substituent having an amido group, A represents $CONHR_2$ or $CONR_2R_3$, wherein $R_2$ represents a hydrogen atom, an alkyl group having from 1 to 10 carbon atoms or an aryl group having from 6 to 15 carbon atoms (the alkyl group or the aryl group may be substituted by a hydroxyl group or an alkoxy group having from 1 to 6 carbon atoms), and when A is a nitrogen-containing heterocyclic ring, A represents an imidazole or a triazole, which groups each may be substituted by an alkyl group having from 1 to 5 carbon atoms or an aryl group having from 6 to 10 carbon atoms.

Specific examples of the compound represented by formula (IV) include (meth)acrylamido, N-alkyl(meth)acrylamido (examples of the alkyl group include a methyl group, an ethyl group, a propyl group, a butyl group, a t-butyl group, a heptyl group, an octyl group, an ethylhexyl group, a cyclohexyl group, a hydroxyethyl group and a benzyl group), N-aryl(meth)acrylamido (examples of the aryl group include a phenyl group, a tolyl group, a nitrophenyl group, a naphthyl group and a hydroxyphenyl group), an N,N-dialkyl(meth)acrylamido (examples of the alkyl group include a methyl group, an ethyl group, a butyl group, an isobutyl group, an ethylhexyl group and a cyclohexyl group), N,N-diaryl(meth)acrylamido (examples of the aryl group include a phenyl group), N-methyl-N-phenyl-(meth)-acrylamido, N-hydroxyethyl-N-methyl(meth)acrylamido, N-2-acetoamidoethyl-N-acetyl(meth)acrylamido, N-(phenylsulfonyl)(meth)acrylamido, N-(p-methylphenylsulfonyl-)(meth)acrylamido, 2-hydroxyphenylacrylamido, 3-hydroxyphenylacrylamido, 4-hydroxyphenylacrylamido, (meth)acryloylmorpholine, 1-vinylimidazole, 1-vinyl-2-methylimidazole, 1-vinyltriazole, 1-vinyl-3,5-dimethylimidazole, vinylpyrrolidone, 4-vinylpyridine and vinylcarbazole.

In formula (V), $R_4$ represents a hydrogen atom or a methyl group; $R_6$, $R_7$ and $R_8$, which may be the same or different, each represents an alkyl group having from 1 to 25 carbon atoms, an aralkyl group having from 7 to 25 carbon atoms, an aryl group having from 6 to 25 carbon atoms (the alkyl group, the aralkyl group or the aryl group may be substituted by a hydroxy group, an alkoxy group having from 1 to 6 carbon atoms, a halogen, a cyano group or a combination of two or more of these groups either directly or via an ether bond, —OCO—, —COO— or a combination of two or more of these groups); and X represents Cl, Br or I.

In a preferred embodiment of formula (V), $R_4$ represents a hydrogen atom or a methyl group, $R_6$, $R_7$ and $R_8$, which may be the same or different, each represents an alkyl group having from 1 to 20 carbon atoms, an aralkyl group having from 7 to 18 carbon atoms or an aryl group having from 6 to 20 carbon atoms (the alkyl group, the aralkyl group or the aryl group may be substituted by an alkoxy group having from 1 to 6 carbon atoms, a halogen, a cyano group or a combination of two or more of these groups either directly or via an ether bond, —OCO—, —COO— or a combination of two or more of these groups) and X represents Cl, Br or I.

Specific examples of the compound represented by formula (V) include N,N,N-(trialkyl)-N-(styrylmethyl)-ammonium chloride, N,N,N-(trialkyl)-N-(styrylmethyl)-ammonium bromide, N,N,N-(trialkyl)-N-(styrylmethyl)-ammonium iodide (examples of the alkyl include a methyl group, an ethyl group, a propyl group, a butyl group, a t-butyl group, a heptyl group, a hexyl group, an octyl group, an isooctyl group, a dodecyl group, an ethylhexyl group and a cyclohexyl group), N,N-(dimethyl)-N-(dodecyl)-N-(styrylmethyl)-ammonium chloride, N,N-(dimethyl)-N-(benzyl)-N-(styrylmethyl)-ammonium chloride, N,N,N-(trimethoxyethyl)-N-(styrylmethyl)-ammonium chloride and N,N-(dimethyl)-N-(phenyl)-N-(styrylmethyl)-ammonium chloride.

Specific examples of other monomers copolymerizable with the monomer represented by formula (IV) and/or formula (V) include compounds having a polymerizable unsaturated bond selected from (meth)acrylic esters, (meth)acrylamides, allyl compounds, vinyl ethers, vinyl esters, styrenes and crotonic acid esters. Specific examples of the compound include (meth)acrylates such as an alkyl (meth)acrylate or substituted alkyl (meth)acrylate (e.g., methyl (meth)acrylate, ethyl (meth)acrylate, propyl (meth)acrylate, isopropyl (meth)acrylate, butyl (meth)acrylate, amyl (meth)acrylate, hexyl (meth)acrylate, cyclohexyl (meth)acrylate, ethylhexyl (meth)acrylate, octyl (meth)acrylate, t-octyl (meth)acrylate, chloroethyl (meth)acrylate, allyl (meth)acrylate, 2-hydroxyethyl (meth)acrylate, 2-hydroxypropyl (meth)acrylate, 4-hydroxybutyl (meth)acrylate, 2,2-dimethyl-3-hydroxypropyl (meth)acrylate, 5-hydroxypentyl (meth)acrylate, trimethylolpropane mono(meth)acrylate, pentaerythritol mono(meth)acrylate, benzyl (meth)acrylate, methoxybenzyl (meth)acrylate, chlorobenzyl (meth)acrylate, furfuryl (meth)acrylate, tetrahydrofurfuryl (meth)acrylate, phenoxyethyl (meth)acrylate), an aryl (meth)acrylate (e.g., phenyl (meth)acrylate, cresyl (meth)acrylate, naphthyl (meth)acrylate); styrenes such as styrene, an alkylstyrene (e.g., methylstyrene, dimethylstyrene, trimethylstyrene, ethylstyrene, diethylstyrene, isopropylstyrene, butylstyrene, hexylstyrene, cyclohexylstyrene, decylstyrene, benzylstyrene, chloromethylstyrene, trifluoromethylstyrene, ethoxymethylstyrene, acetoxymethylstyrene), an alkoxystyrene (e.g., methoxystyrene, 4-methoxy-3-methylstyrene, dimethoxystyrene), a halogenostyrene (e.g., chlorostyrene, dichlorostyrene, trichlorostyrene, tetrachlorostyrene, pentachlorostyrene, bromostyrene, dibromostyrene, iodostyrene, fluorostyrene, trifluorostyrene, 2-bromo-4-trifluorostyrene, 4-fluoro-3-trifluoromethylstyrene) and a hydroxystyrene; cronic acid esters such as alkyl crotonate (e.g., butyl crotonate, hexyl crotonate, glycerine monocrotonate); a (meth)acrylic acid; a crotonic acid; an itaconic acid; and a (meth)acrylonitrile.

Preferred specific examples of the polymer having a repeating unit represented by formula (II) and/or formula (III) include an N,N-dimethylacrylamido/butyl (meth)acrylate copolymer, an N,N-dimethyl (meth)acrylamido/2-ethylhexyl (meth)acrylate copolymer, an N,N-dimethyl (meth)-acrylamido/hexyl (meth)acrylate copolymer, an N-butyl(meth)acrylamido/butyl (meth)acrylate copolymer, an N-butyl(meth)acrylamido/2-ethylhexyl (meth)acrylate copolymer, an N-butyl(meth)acrylamido/hexyl (meth)acrylate copolymer, a (meth)acryloylmorpholine/butyl (meth)acrylate copolymer, a (meth)acryloylmorpholine/2-ethylhexyl (meth)acrylate copolymer, a (meth)acryloylmorpholine/hexyl (meth)acrylate copolymer, a 1-vinylimidazole/butyl (meth)acrylate copolymer, a 1-vinylimidazole/2-ethylhexyl (meth)acrylate copolymer, 1-vinylimidazole/hexyl (meth)acrylate copolymer, an N,N-dimethylacrylamido/butyl (meth)acrylate/N,N,N-(trihexyl)-N-(styrylmethyl)-ammonium chloride copolymer, an N,N-dimethylacrylamido/butyl (meth)acrylate/N,N,N-(trioctyl)-N-(styrylmethyl)-ammonium chloride copolymer, an N,N-dimethylacrylamido/butyl (meth)acrylate/N,N,N-(tridodecyl)-N-(styrylmethyl)-ammonium chloride copolymer, an N,N-dimethylacrylamido/butyl (meth)acrylate/N,N,N-(trihexyl)-N-(styrylmethyl)-ammonium iodide copolymer, an N,N-dimethyl(meth)acrylamido/hexyl (meth) acrylate/N,N,N-(trihexyl)-N-(styrylmethyl)-ammonium chloride copolymer, a (meth)acryloylmorpholine/2-ethylhexyl (meth)acrylate/N,N-(dimethyl)-N-(benzyl)-N-(styrylmethyl)-ammonium chloride copolymer, an N-butyl-(meth)acrylamido/hexyl (meth)acrylate/N,N,N-(trimethoxyethyl)-N-(styrylmethyl)-ammonium chloride copolymer and an N,N,N-(trihexyl)-N-(styrylmethyl)-ammonium chloride copolymer.

The content of the repeating unit represented by the formula (II) and/or formula (III) of the high molecular weight compound is preferably from 5 to 100 mol %, more preferably from 10 to 100 mol %. If the content of the repeating unit represented by the formula (II) and/or formula (III) is less than 5 mol %, the image quality is inferior. The weight average molecular weight is preferably from 1,000 to 200,000, more preferably from 2,000 to 100,000. If the molecular weight is less than 1,000, production is difficult, whereas if it exceeds 200,000, solubility in a solvent is lowered.

The high molecular weight compound having a repeating unit represented by formula (II) and/or formula (III) is added to the second image-receiving layer in an amount, based on the total solid content, of preferably from 0 to 50 wt %. If the addition amount exceeds 50 wt %, the second image-receiving layer becomes tacky on the surface thereof and presents difficulty in handling. The addition amount is more preferably from 0 to 40 wt %, most preferably from 5 to 40 wt %.

Other resins may further be added to the second image-receiving layer, if desired, within a range such that the performance is not adversely affected. Various resins may be used in combination and examples thereof include a polyolefin such as polyethylene and polypropylene, an ethylene copolymer such as ethylene/vinyl acetate copolymer, ethylene/acrylate copolymer and ethyl/acrylic acid copolymer, a vinyl chloride copolymer such as polyvinyl chloride and vinyl chloride/vinyl acetate copolymer, a polyvinylidene chloride, a vinylidene chloride copolymer, a styrene copolymer such as polystyrene and styrene/maleate copolymer, a polyalkyl (meth)acrylate (co)polymer, an alkyl (meth)acrylate/(meth)acrylic acid copolymer, a poly(meth)acrylamido (co)polymer such as polyalkyl (meth)acrylamido, a vinyl acetate copolymer, a butyral resin, a modified polyvinyl alcohol, a polyvinyl pyrrolidone, a polyethylene glycol, a polyamido resin such as a copolymer of nylon and N-alkoxymethylated nylon, a synthetic rubber, a rubber chloride, a phenolic resin, an epoxy resin, a urethane resin, a urea resin, a melamine resin, an alkyd resin, a maleic acid resin, a hydroxystyrene copolymer, a sulfonamide resin, an ester gum, a cellulose resin, a nitrocellulose, a rosin, a starch and a polyethyleneimine.

It is of course possible to also add an adhesion improving agent, a releasing agent, a plasticizer or a surface active agent to the above-described resin so as to satisfy the relation of respective interfaces in terms of adhesion strength.

The coating solvent for coating the second image-receiving layer is a coating solvent which does not dissolve or swell the resin used in the first image-receiving layer so that the first image-receiving layer and the second image-receiving layer are not mixed with each other due to penetration of the coating solvent into the lower layer upon coating. For example, when a vinyl chloride-based resin having a relative good solubility in various solvents is used in the first image-receiving layer, an alcohol or aqueous coating solvent is preferably used in the second image-receiving layer.

The thickness of the second image-receiving layer is preferably approximately from 0.1 to 10 μm, more preferably from 0.5 to 5 μm. If the thickness is too large, irregularities present on the surface of the permanent support is obscured, and the gloss is excessively intensified to deteriorate the printed matter approximation.

In order to impart an interlayer release between the organic polymer material of the first image-receiving layer and the organic polymer material of the second image-receiving layer upon peeling the image-receiving sheet material to effect transfer to the permanent support, the balance of adhesive strength between respective layers is important. To control the interlayer adhesive strength, mixing of materials must be prevented upon coating of layers in a superimposed manner in accordance with the present invention. To this effect, in addition to selection of the coating solvent, it is effective to select materials such that a hydrophilic polymer and an oleophilic polymer or a polar polymer and a nonpolar polymer are used in combination, or to add an adhesion improving agent such as a silane coupling agent, various fluorine or silicone additives capable of providing a releasing effect, a surface active agent or a plasticizer to the first image-receiving layer or the second image-receiving layer.

In order to improve slipperiness or flaw resistance of the image-receiving layer, a layer of various releasing agents or lubricants may be provided as an overcoat layer on the second image-receiving layer, that is, on the layer which receives the heat transferable ink layer. Specific examples of these agents include a higher fatty acid such as palmitic acid and stearic acid, a fatty acid metal salt such as zinc stearate, a fatty acid ester or a partial saponification product thereof, a fatty acid derivative such as fatty acid amide, a higher alcohol, an ester derivative of a polyhydric alcohol, a wax such as paraffin wax, carnauba wax, montan wax, beeswax, Japan wax and candelilla wax, a cationic surface active agent such as an ammonium salt and a pyridium salt each having a long chained aliphatic group, an anionic or non-ionic surface active agent having a long chained aliphatic group and a perfluoro surface active agent, and one or more of these may be selected.

An interlayer may also be provided between the first image-receiving layer and the second image-receiving layer for controlling transferability. Furthermore, a layer intended to improve slipperiness or flaw resistance between image-receiving sheets may be provided on the support opposite the side having the first image-receiving layer and the second image-receiving layer.

A transfer material comprising a support having thereon an ink layer capable of heat transfer (hereinafter referred to as "heat transfer sheet") for use in the present invention is described below.

Various supports known as a support for conventional fusion transfer or sublimation transfer may be used as the support of the heat transfer sheet. However, similar to the sensitive material commonly used for thermal head transfer, a polyester film having a thickness of about 5 μm with the back surface being subjected to a releasing treatment is particularly preferred.

Examples of the material for use in the support for the heat transfer sheet include polyolefines such as polyethylene and polypropylene, polyvinyl halides such as polyvinyl chloride and polyvinylidene chloride, cellulose derivatives such as cellulose acetate, nitrocellulose and cellophane, and polyesters such as polyethylene terephthalate, polyethylene naphthalate and a biaxially stretched film thereof.

The ink layer of the heat transfer sheet contains a coloring material (predominantly a pigment) and a non-crystalline organic polymer binder material as main components. Various known pigments can be used as the pigment, and examples thereof include carbon black, an azo pigment, a phthalocyanine pigment, a quinacridone pigment, a thioindigo pigment, an anthraquinone pigment and an isoindoline pigment. These pigments may be used in combination of two or more thereof, or a known dye may also be added thereto so as to adjust the hue.

The noncrystalline organic polymer binder material preferably has a softening point of from 50° to 150° C., and examples thereof include a butyral resin, a polyamido resin, a polyethyleneimine resin, a sulfonamide resin, a polyester polyol resin, a petroleum resin, styrene or a derivative thereof such as vinyltoluene, α-methylstyrene, 2-methylstyrene, chlorostyrene, vinylbenzoic acid, sodium vinylbenzene sulfonate and aminostyrene and a homopolymer or a copolymer of these derivatives or substitution products, a methacrylic acid or a methacrylate such as methyl methacrylate, ethyl methacrylate, butyl methacrylate and hydroxyethyl methacrylate, an acrylic acid or acrylate such as methyl acrylate, ethyl acrylate, butyl acrylate and α-ethylhexyl acrylate, a diene such as butadiene and isoprene, an acrylonitrile, a vinyl ether, a maleic acid or maleic ester, a maleic anhydride, a cinnamic acid and a homopolymer of a vinyl monomer such as vinyl chloride or vinyl acetate or a copolymer thereof with other monomers. These resins may be used in combination of two or more thereof.

Among these, particularly preferred are a butyral resin and a styrene/maleic acid half ester resin in view of dispersibility which is one of features of the present invention. This resin preferably has a softening point of from 50° to 150° C. If the softening point exceeds 150° C., the heat recording sensitivity is low, whereas if it is less than 50° C., the ink layer is inferior in resistance to adhesion.

The ink layer may contain a releasing agent or a softening agent in an amount of from 1 to 20 wt % based on the total weight of the ink layer so as to improve releasability of the ink layer from the support or to improve heat sensitivity upon heat printing. Specific examples of these agents include a higher fatty acid such as palmitic acid and stearic acid, a fatty acid metal salt such as zinc stearate, a fatty acid ester or a partial saponification product thereof, a fatty acid derivative such as a fatty acid amido, a higher alcohol, an ester derivative of a polyhydric alcohol, a wax such as paraffin wax, carnauba wax, montan wax, beeswax, Japan wax and candelilla wax, a low molecular weight polyolefin such as polyethylene, polypropylene and polybutylene each having a viscosity average molecular weight of from about 1,000 to about 10,000, a low molecular weight copolymer of an olefin or an α-olefin with an organic acid such as maleic anhydride, acrylic acid or methacrylic acid or with vinyl acetate, a low molecular weight polyolefin oxide, a polyolefin halide, a methacrylate having a long-chained alkyl side chain such as lauryl methacrylate and stearyl methacrylate, acrylate or an acrylate having a perfluoro group, a homopolymer of a methacrylate or a copolymer thereof with a vinyl monomer such as styrene, a low molecular weight silicone resin such as polydimethylsiloxane and polydiphenylsiloxane, a silicone-modified organic material, a cationic surface active agent such as an ammonium salt and a pyridium salt each having a long chained aliphatic group, an anionic or nonionic surface active agent having a long chained aliphatic group and a perfluoro surface active agent, and one or more of these may be selected.

The heat transferable ink layer preferably has an optical density such that the reflection density after heat transferred to a white support is 1.0 or more for obtaining an image having excellent printed matter approximation. The thickness of the ink layer is preferably from 0.2 to 1.0 μm. If the thickness of the ink layer exceeds 1.0 μm, in reproducing gradation by area gradation only, the shadow part easily vanishes or the highlight part is prone to jumping, which results in inferior reproduction of gradation. On the other hand, if it is less than 0.2 μm, it is difficult to achieve the desired density.

In order to achieve a desired density with such a thin film, the ink layer preferably comprises from 30 to 70 parts by weight of a pigment, from 25 to 60 parts by weight of a noncrystalline organic polymer binder material per 100 parts by weight of the ink layer. Furthermore, the total amounts of the releasing substance and the softening agent which added, if desired, is preferably from 1 to 15 parts by weight per 100 parts by weight of the ink layer. If the pigment ratio is less than 30 parts by weight, it is difficult to achieve the desired density with the above-described layer thickness. Furthermore, 70% of the pigment preferably have a particle size of 1.0 μm or less. If the particle size is larger than 1.0 μm, the transparency may be impaired upon reproduction of colors on the part where respective colors are superimposed. In addition, it is difficult to satisfy the layer thickness and the desired density at the same time.

The pigment may be dispersed in the noncrystalline organic polymer binder material by adding thereto an appropriate solvent using various dispersion means commonly used in the paint field including a ball mill.

The heat transferable ink layer comprises as main components a pigment and a noncrystalline organic polymer binder material, has a high pigment ratio as compared with a conventional wax-fusion type ink layer and does not undergo reduction in viscosity upon heat transferring to from $10^2$ to $10^3$ cps as compared with commonly used fusion type ink layers. Rather, the heat transferable ink layer has a viscosity of at least $10^4$ cps or more at a temperature of 150° C. Thus, the present invention provides a thin film releasing development type image formation technique using the heat adhesion property of the receiving sheet or, in the case of forming a color image, the heat adhesion property between the receiving sheet and the ink layer. In combination with the effect ascribable to the thinned ink layer, this technique can achieve reproduction of gradation over a wide range from a shadow part to a highlight part, good edge sharpness and 100% transfer of an image while maintaining high resolution. As a result, for example, a small character of 4 point and the solid part can have a uniform density.

The present invention will be described below in greater detail by referring to the following Examples, but the present invention should not be construed as being limited thereto.

EXAMPLES

Synthesis of Modified Polyvinyl Acetal Resin:

Synthesis Example 1

105.1 parts of polyvinyl butyral (S-LEK B BX-10, produced by Sekisui Chemical Co., Ltd.) was dissolved in 389.7 parts of acetone. 24.8 Parts (0.5 equivalents to the hydroxyl group) of butyl isocyanate was added thereto. 0.03 part of dibutyltin diacetate was further added thereto and the mixture was stirred under heating at 30° C. for 10 hours. The resulting solution was poured into 5 l of water, purified by reprecipitation, further washed with water and dried to obtain 120.6 parts of a resin where the hydroxyl group of the polyvinyl butyral starting material had been converted into a urethane group (Resin No. 1).

Synthesis Examples 2 to 13

Using the resins and isocyanates shown in Table 1, modified polyvinyl acetal resins (Resin Nos. 2 to 13) were obtained in the same manner as in Synthesis Example 1.

TABLE 1

Modified Polyvinyl Acetal Resins

| Synthesis Example | Resin No. | Raw Material Resin | Isocyanate (equivalents to hydroxyl group) |
|---|---|---|---|
| 2 | 2 | BX-10 | butyl isocyanate (1.0) |
| 3 | 3 | " | n-propyl isocyanate (1.0) |
| 4 | 4 | " | cyclohexyl isocyanate (0.2) |
| 5 | 5 | " | cyclohexyl isocyanate (0.5) |
| 6 | 6 | " | cyclohexyl isocyanate (1.0) |
| 7 | 7 | " | phenyl isocyanate (1.0) |
| 8 | 8 | #2000 L | butyl isocyanate (1.0) |
| 9 | 9 | " | cyclohexyl isocyanate (1.0) |
| 10 | 10 | KS-10 | butyl isocyanate (1.0) |
| 11 | 11 | " | n-propylisocyanate (1.0) |
| 12 | 12 | BL-SH | butyl isocyanate (1.0) |
| 13 | 13 | " | cyclohexyl isocyanate (1.0) |

BX-10, BL-SH: polyvinyl butyral, S-LEK B Series produced by Sekisui Chemical Co., Ltd.
KS-1: polyvinyl butyral formal, S-LEK K Series produced by Sekisui Chemical Co., Ltd.
#2000 L: polyvinyl butyral produced by Denki Kagaku Kogyo K.K.

Synthesis Example 14

105.1 parts of polyvinyl butyral (S-LEK B BX-10, produced by Sekisui Chemical Co., Ltd.) was dissolved in 232.1 parts of methyl ethyl ketone. 49.6 parts (1.0 equivalent to the hydroxyl group) of butylisocyanate was added thereto. 0.09 part of dibutyltin diacetate was further added thereto, and the mixture was stirred under heating at 40° C. for 6 hours to obtain a 40 wt % methyl ethyl ketone solution of a resin where the hydroxyl group of the polyvinyl butyral had been converted into a urethane group (Resin No. 14).

Synthesis Examples 15 to 17

A 40 wt % methyl ethyl ketone solution of each of modified polyvinyl acetal resins (Resin Nos. 15 to 17) was prepared in the same manner as in Synthesis Example 14 using the resin and isocyanate used in Synthesis Example 6, 10 and 12, respectively. Synthesis Example 18

63.1 parts of polyvinyl butyral (S-LEK B BX-10, produced by Sekisui Chemical Co., Ltd.), 22.8 parts of triethylamine and 0.7 part of dimethylaminopyridine were dissolved in 189.3 parts of acetone. 44.4 parts (1.0 equivalent to the hydroxyl group) of phthalic anhydride was added thereto. After allowing the mixture to react at room temperature for 10 hours, the resulting solution was poured into 5 l of water, purified by reprecipitation, further washed with water and dried to obtain 87.6 parts of a resin where the hydroxyl group of the polyvinyl butyral had been converted into a phthalic acid half ester group (Resin No. 18).

Synthesis Example 19

8.8 parts of sodium hydride (oiliness) was added to 136 parts of dry tetrahydrofuran. 42.0 parts of polyvinyl butyral (S-LEK B BX-10, produced by Sekisui Chemical Co., Ltd.) was added thereto little by little. After stirring the mixture at room temperature for one hour, 34.2 parts (1.0 equivalent to the hydroxyl group) of benzyl bromide was added dropwise. The resulting solution was stirred while heating under reflux for 10 hours. The reaction solution was poured into 3 l of water containing 9 ml of hydrochloric acid, purified by reprecipitation, further washed with water and dried to obtain 43.9 parts of a resin where the hydroxyl group of the polyvinyl butyral had been converted into a benzyl ether group (Resin No. 19).

Synthesis Example 20

63.1 parts of polyvinyl butyral (S-LEK B BX-10, produced by Sekisui Chemical Co., Ltd.) and 0.49 parts of sodium acetate were dissolved in 189.3 parts of acetone. 25.2 Parts (1.0 equivalent to the hydroxyl group) of diketene was added thereto. The resulting solution was stirred while heating under reflux for 10 hours. The reaction solution was poured into 5 l of water, purified by reprecipitation, further washed with water and dried to obtain 75.3 parts of a resin where the hydroxyl group of the polyvinyl butyral had been converted into an acetylacetonate group (Resin No. 20).

Synthesis of High Molecular Weight Compound having Repeating Unit represented by Formula (II) and/or Formula (III):

Synthesis Example 21

170 parts of propylene glycol monomethyl ether was stirred while heating at 80° C. under a nitrogen stream and 0.07 part of 2,2'-azobis(2,4-dimethylvaleronitrile) was added thereto and stirred for 30 minutes. 31.6 Parts of butyl acrylate, 24.4 parts of N,N-dimethyl acrylamide and 0.07 part of 2,2'-azobis(2,4-dimethylvaleronitrile) were added dropwise thereto over a period of 30 minutes. 0.15 part of 2,2'-azobis(2,4-dimethylvaleronitrile) was further added 30 minutes and one hour after the completion of the dropwise addition, respectively, and the mixture was stirred while heating for 4 hours to obtain a 28% propylene glycol monomethyl ether solution of a high molecular weight compound (Resin No. 21). The weight average molecular weight (in terms of polystyrene) was 13,000.

Synthesis Examples 22 to 24

By following the process in Synthesis Example 21 but using the monomers shown in Table 2, high molecular weight compounds (Resin Nos. 22 to 24) were obtained.

TABLE 2

High Molecular Weight Compound

| Synthesis Example (Resin No.) | Raw Material Monomer (molar ratio) | Weight Average Molecular Weight |
|---|---|---|
| 22 | butyl methacrylate/ vinylimidazole = (1/1) | 16,000 |
| 23 | N,N,N-(trihexyl)-N-(styrylmethyl)-ammonium chloride | 3,800 |
| 24 | butyl methacrylate/N,N-dimethyl acrylamido/N,N,N-(trihexyl)-N-(styrylmethyl)-ammonium chloride = (5/5/1) | 3,900 |

Example 1

Preparation of Image-Receiving Sheet Material:

Coating solutions for the first image-receiving layer and the second image-receiving layer were prepared each having the following composition.

Coating Solution for the First Image-Receiving Layer:

| | |
|---|---|
| Binder: | 25 parts by weight |
| vinyl chloride/vinyl acetate copolymer (MPR-TSL, produced by Nisshin Kagaku K.K.) | |
| Plasticizer: | 12 parts by weight |
| dibutyloctyl phthalate (DOP, produced by Daihachi Chemical Industry Co., Ltd.) | |
| Surface active agent: | 4 parts by weight |
| (Megafac F-177P, trade name, produced by Dainippon Ink & Chemicals, Inc.) | |
| Solvent: methyl ethyl ketone | 75 parts by weight |

Coating Solution for the Second Image-Receiving Layer:

| | |
|---|---|
| Resin No. 1 | 16 parts by weight |
| Resin No. 24 | 4 parts by weight |
| Polyethyleneimine resin | 0.5 part by weight |
| (Polyethyleneimine SP-200, trade name, produced by Nippon Shokubai Kagaku Kogyo Co., Ltd.) | |
| Surface active agent: | 0.5 part by weight |
| (Megafac F-177P, trade name, produced by Dainippon Ink & Chemicals, Inc.) | |
| Solvent: n-propyl alcohol | 200 parts by weight |

The above-described coating solution for the first image-receiving layer was coated on a 100 μm-thick polyethylene terephthalate (PET) film support by means of a rotary coater (wheeler) at 300 rpm and dried in an oven at 100° C. for 2 minutes. The resulting first image-receiving layer had a thickness of 20 μm. On the thus-obtained first image-receiving layer, the above-described coating solution for the second image-receiving layer was coated by means of a rotary coater (wheeler) at 200 rpm and dried in an oven at 100° C. for 2 minutes. The resulting second image-receiving layer had a thickness of 2 μm.

Preparation of Heat Transfer Sheet:

The following three kinds of pigment dispersion solutions for the ink layer were prepared.

| | | | |
|---|---|---|---|
| Butyral resin: | 12 parts by weight | | |
| (Denkabutyral #2000-L, produced by Denki Kagaku Kogyo K.K.) | | | |
| Pigment: | A | B | C |
| | (parts by weight) | | |
| Cyan pigment (C.I. P.B. 15:4) | 12 | | |
| Magenta pigment (C.I. P.R. 57:1) | — | 12 | |
| Yellow pigment (C.I. P.Y. 14) | — | — | 12 |
| Dispersion aid | 0.8 part by weight | | |
| Solsperse S-20000 (ICI Japan K.K.) | | | |
| Solvent: n-propyl alcohol | 110 parts by weight | | |

To 10 parts by weight of each of the above-described pigment dispersion solutions A, B and C, 0.24 part by weight of stearic acid amide and 60 parts by weight of n-propyl alcohol were added to obtain coating solutions. The coating solutions were each coated on a 5 μm-thick polyester film (produced by Teijin Limited) which had been subjected on the back surface thereof to a releasing treatment to give a dry thickness of 0.36 μm for dispersion A, 0.38 μm for dispersion B and 0.42 μm for dispersion C, to obtain heat transfer sheets.

The cyan heat transfer sheet was superimposed on the image-receiving sheet material, and printing was conducted using a thermal head recording apparatus (experimental model) according to a secondary scanning division method. In this system, a head of 75 μm×50 μm is driven into microfeeding in the 50 μm direction and subjected to on-off operation at a 3 μm pitch to effect multistage modulation of area gradation only. The cyan heat transfer sheet was peeled off to form an image composed of area gradation only on the image-receiving sheet material. Then, the magenta heat transfer sheet was superimposed on the image-receiving sheet material on which the cyan image was formed, positioned and printed in the same manner as described above, and the heat transfer sheet was peeled off to obtain a magenta image on the image-receiving sheet material. A yellow image was formed in the same manner as described above, and a color image composed of area gradation only was formed on the image-receiving sheet material. Thereafter, the image-receiving sheet material having formed thereon a color image was superimposed on an art paper, a heat roller at 130° C. was rolled over the laminate under a pressure of 4.5 kg/cm at a speed of 4 m/sec, and then the polyester film of the image-receiving sheet material was peeled off to transfer the image-receiving second layer having thereon an ink image onto the art paper to thereby form a color image. The resulting color image exhibited very good color image approximation to a chemical proof (Color Art, trade name, produced by Fuji Photo Film Co., Ltd.) produced from a lith original. Each monochrome had a reflection density as shown below.

| | Optical Density (solid part) |
|---|---|
| Cyan | 1.54 |
| Magenta | 1.42 |
| Yellow | 1.57 |

The density of a 4P character was measured using a microdensitometer, and the density thus determined was equal to the density of a solid part. The gradation reproduction was observed in the range of from 5 to 95% there were no apparent flaws due to dust and the dot shape was good. Furthermore, the transferred second image receiving layer conformed to irregularities of the paper. As a result, the surface of the product was duly matted to give the image a surface gloss very approximate to that of a printed matter.

Examples 2 to 25 and Comparative Examples 1 to 9

Image-receiving sheets were prepared in the same manner as in Example 1, except for changing the composition of the modified polyvinyl butyral resin (Resin No. 1) and the high molecular weight compound (Resin No. 24) of Synthesis Example 1 in Example 1, as shown in Table 3. Using each of these image-receiving sheets, a color image was formed in the same manner as in Example 1, and then the image was evaluated. The evaluation results are shown in Table 4.

TABLE 3

| | Second Image-Receiving Layer | | | | | | | |
|---|---|---|---|---|---|---|---|---|
| | Modified Polyvinyl Acetal Resin | | High Molecular Weight Compound | | Other Resin | | Other Resin | |
| | Resin No. | Addition Amount | Resin No. | Addition Amount | Resin Name | Addition Amount | Resin Name | Addition Amount |
| Example 1 | 1 | 16 | 24 | 4 | — | — | SP-200 | 0.5 |
| Example 2 | 2 | 16 | 24 | 4 | — | — | SP-200 | 0.5 |
| Example 3 | 3 | 16 | 24 | 4 | — | — | SP-200 | 0.5 |
| Example 4 | 4 | 16 | 24 | 4 | — | — | SP-200 | 0.5 |
| Example 5 | 5 | 12.8 | 24 | 4 | BL-SH | 3.2 | SP-200 | 0.5 |
| Example 6 | 6 | 12.8 | 24 | 4 | BL-SH | 3.2 | SP-200 | 0.5 |
| Example 7 | 7 | 16 | 24 | 4 | — | — | SP-200 | 0.5 |
| Example 8 | 8 | 16 | 24 | 4 | — | — | SP-200 | 0.5 |
| Example 9 | 9 | 16 | 24 | 4 | — | — | SP-200 | 0.5 |
| Example 10 | 10 | 16 | 24 | 4 | — | — | SP-200 | 0.5 |
| Example 11 | 11 | 16 | 24 | 4 | — | — | SP-200 | 0.5 |
| Example 12 | 12 | 16 | 24 | 4 | — | — | SP-200 | 0.5 |
| Example 13 | 13 | 16 | 24 | 4 | — | — | SP-200 | 0.5 |
| Example 14 | 14 | 40 | 24 | 4 | — | — | SP-200 | 0.5 |
| Example 15 | 15 | 40 | 24 | 4 | — | — | SP-200 | 0.5 |
| Example 16 | 16 | 40 | 24 | 4 | — | — | SP-200 | 0.5 |
| Example 17 | 17 | 40 | 24 | 4 | — | — | SP-200 | 0.5 |
| Example 18 | 18 | 40 | 24 | 4 | — | — | SP-200 | 0.5 |
| Example 19 | 19 | 16 | 24 | 4 | — | — | SP-200 | 0.5 |
| Example 20 | 20 | 12.8 | 24 | 4 | BL-SH | 3.2 | — | — |
| Example 21 | 2 | 16 | 21 | 4 | — | — | — | — |
| Example 22 | 2 | 16 | 22 | 4 | — | — | — | — |
| Example 23 | 2 | 16 | 23 | 4 | — | — | — | — |
| Example 24 | 2 | 20 | — | — | — | — | — | — |
| Example 25 | 9 | 20 | — | — | — | — | — | — |
| Comparative Example 1 | — | — | 24 | 4 | BX-10 | 16 | SP-200 | 0.5 |
| Comparative Example 2 | — | — | 24 | 4 | BL-SH | 16 | SP-200 | 0.5 |
| Comparative Example 3 | — | — | 24 | 4 | 2000L | 16 | SP-200 | 0.5 |
| Comparative Example 4 | — | — | 24 | 4 | KS-10 | 16 | SP-200 | 0.5 |
| Comparative Example 5 | — | — | — | — | BX-10 | 16 | SP-200 | 0.5 |
| Comparative Example 6 | — | — | — | — | BL-SH | 16 | SP-200 | 0.5 |
| Comparative Example 7 | — | — | — | — | 2000L | 16 | SP-200 | 0.5 |
| Comparative Example 8 | — | — | — | — | KS-10 | 16 | — | — |

BL-SH: polyvinyl butyral, S-LEK B Series, produced by Sekisui Chemical Co., Ltd.
SP-200: polyethyleneimine, produced by Nippon Shokubai Kagaku Kogyo Co., Ltd.
All addition amount are given as parts by weight.

EXAMPLE 4

| | Evaluation Results of Composition | | | | | |
|---|---|---|---|---|---|---|
| | Dot Quality | Gradation Property | Surface Tackiness | Sticking | Dust Flaws | Humidity Dependency |
| Example 1 | Good | Good | Good | Good | Good | Good |
| Example 2 | Good | Good | Good | Good | Good | Good |
| Example 3 | Good | Good | Good | Good | Good | Good |
| Example 4 | Good | Good | Good | Good | Good | Good |
| Example 5 | Good | Good | Good | Good | Good | Good |
| Example 6 | Good | Good | Good | Good | Good | Good |
| Example 7 | Good | Good | Good | Good | Good | Good |
| Example 8 | Good | Good | Good | Good | Good | Good |
| Example 9 | Good | Good | Good | Good | Good | Good |
| Example 10 | Good | Good | Good | Good | Good | Good |
| Example 11 | Good | Good | Good | Good | Good | Good |
| Example 12 | Good | Good | Good | Good | Good | Good |
| Example 13 | Good | Good | Good | Good | Good | Good |
| Example 14 | Good | Good | Good | Good | Good | Good |
| Example 15 | Good | Good | Good | Good | Good | Good |
| Example 16 | Good | Good | Good | Good | Good | Good |
| Example 17 | Good | Good | Good | Good | Good | Good |

EXAMPLE 4-continued

| | Evaluation Results of Composition | | | | | |
|---|---|---|---|---|---|---|
| | Dot Quality | Gradation Property | Surface Tackiness | Sticking | Dust Flaws | Humidity Dependency |
| Example 18 | Good | Good | Good | Good | Good | Good |
| Example 19 | Good | Good | Good | Good | Good | Good |
| Example 20 | Good | Good | Good | Good | Good | Good |
| Example 21 | Good | Good | Good | Good | Good | Good |
| Example 22 | Good | Good | Good | Good | Good | Good |
| Example 23 | Good | Good | Good | Good | Good | Good |
| Example 24 | Good | Good | Good | Good | Good | Good |
| Example 25 | Good | Good | Good | Good | Good | Good |
| Comparative Example 1 | Good | Good | Good | Good | Good | Bad |
| Comparative Example 2 | Good | Good | Bad | Good | Bad | Good |
| Comparative Example 3 | Good | Good | Bad | Good | Good | Bad |
| Comparative Example 4 | Bad | Good | Good | Good | Good | Bad |
| Comparative Example 5 | Bad | Bad | Good | Good | Good | Bad |
| Comparative Example 6 | Bad | Bad | Bad | Good | Bad | Good |
| Comparative Example 7 | Bad | Good | Bad | Good | Bad | Bad |
| Comparative Example 8 | Bad | Bad | Good | Good | Good | Bad |
| Comparative Example 9 | Good | Good | Bad | Good | Good | Bad |

Evaluation Method of Humidity Dependency:

An image was formed as in Example 1 at 25° C. under low humidity conditions of 20% relative humidity. A printing energy giving a dot percent of 50% under the above-described conditions was determined. Using this resulting printing energy, image printing was conducted at 25° C. under high humidity conditions of 80% relative humidity, and the dot percent under the higher humidity conditions was measured. Images having a dot percent of 68% or less (3% or less as a rate of change per 10% changes in humidity) were evaluated as being good, and those having a lower dot percent were evaluated as being bad.

Example 26

(1) Preparation of Heat Transfer Sheet (a) Preparation of Light-Heat Conversion Layer Preparation of Mother Solution for Coating Solution:

| | |
|---|---|
| Carbon black | 20 parts by weight |
| (Mitsubishi Carbon Black, MK-100, C.I. Pigment Black 7, produced by Mitsubishi Chemical Industries, Ltd.) | |
| Dispersion aid | 6 parts by weight |
| (Joncryl J-62, 30% aq. soln., produced by Johnson Polymer K.K.) | |
| Ion exchange water | 80 parts by weight |
| Isopropyl alcohol | 20 parts by weight |
| Glass beads | 100 parts by weight |

The above-described components were processed into a dispersion for 2 hours using a Paint Shaker (manufactured by Toyo Seiki K.K.) to prepare a mother solution.

Preparation of Coating Solution:

| | |
|---|---|
| Mother solution obtained above | 100 parts by weight |
| Polyvinyl alcohol (Poly (vinyl alcohol) Type 205, produced by Kuraray Co., Ltd.) | 3 parts by weight |
| Isopropyl alcohol | 100 parts by weight |
| Ion exchange water | 450 parts by weight |

The above-described components were mixed while stirring with a stirrer to prepare a coating solution for a light-heat conversion layer.

Preparation of Support:

A styrene-butadiene copolymer (thickness: 0.5 μm) and gelatin (thickness: 0.1 μm) were provided in this order as undercoat layers on a polyethylene terephthalate film having a thickness of 75 μm to prepare a support for the heat transfer sheet. On this support, the above-described coating solution for the light-heat conversion layer was coated over a period of 1 minute using a rotary coater (wheeler), and the coating was dried in an oven at 100° C. for 2 minutes to form a light-heat conventions layer (thickness determined by a stylus type film thickness gauge: 0.3 μm, light absorbance at a wavelength of 488 nm: 90%). The same sample was observed in cross-section by a scanning type electron microscope, and the average film thickness was found to be 0.3 μm.

(b) Lamination of Heat Releasing Layer

Preparation of Coating Solution:

| | |
|---|---|
| Nitrocellulose (Type RS1/2, produced by DAICEL Chemical Industries Ltd.) | 1 part by weight |
| Methyl ethyl ketone | 100 parts by weight |
| Propylene glycol monomethyl ether acetate | 20 parts by weight |

The above-described components were mixed while stirring with a stirrer to prepare a coating solution for the heat releasing layer.

Coating of Heat Releasing Layer and Measurement of Film Thickness:

On the surface of the above-described light-heat conversion layer provided on the support of the heat transfer sheet, the coating solution for the heat releasing layer prepared above was coated over a period of 1 minute using a rotary coater (wheeler), and the coating was dried in an oven at 100° C. for 2 minutes. The coating solution for the heat releasing layer was also coated on a polyester film (thickness: 100 μm) having a smooth surface and dried under the same conditions. The film thickness at this time was measured by a stylus type film thickness gauge and found to be 0.1 μm.

(c) Lamination of Image Forming Layer (Magenta)

Preparation of Mother Solution for Coating Solution:

| | |
|---|---|
| Polyvinyl butyral (Denkabutyral #2000-L, produced by Denka Kagaku Kogyo K.K., 20 wt % solution (solvent: n-propyl alcohol)) | 63 parts by weight |
| Coloring material (Lionol Red 6B4290G, produced by Toyo Ink Manufacturing Co., Ltd., a magenta pigment, C.I. Pigment Red 57:1) | 12 parts by weight |
| Dispersion aid (Solsperse S-20,000, produced by ICI K.K.) | 0.8 part by weight |
| n-Propyl alcohol | 60 parts by weight |
| Glass beads | 100 parts by weight |

The above-described components were processed into a dispersion for 2 hours using a Paint Shaker (manufactured by Toyo Seiki K.K.) to prepare a mother solution.

Preparation of Coating Solution:

| | |
|---|---|
| Mother solution obtained above | 10 parts by weight |
| n-Propyl alcohol | 60 parts by weight |
| Surface active agent (Megafac F-176PF, produced by Dainippon Ink & Chemicals, Inc.) | 0.05 part by weight |

The above-described components were mixed while stirring with a stirrer to prepare a coating solution for the magenta image forming layer.

Coating of Coating Solution for Magenta Image Forming Layer and Measurement of Film Thickness:

On the surface of the above-described heat releasing layer provided on the support of the heat transfer sheet, the coating solution for the image forming layer prepared above was coated over a period of 1 minute using a rotary coater (wheeler). The coating was dried in an oven at 100° C. for 2 minutes to laminate an image-forming layer having an optical density as determined by a Macbeth densitometer of 0.7 to thereby produce a heat transfer sheet. The above-described coating solution for the image forming layer was also coated on a polyester film (thickness: 100 μm) under the same conditions and dried, and the film thickness was measured and found to be 0.3 μm. The film thickness of the magenta image forming layer of the heat transfer sheet was measured by a cross section observation method, and the average thereof was nearly 0.3 μm.

(2) Preparation of Image-Receiving Sheet Material

An image-receiving sheet material was prepared in the same manner as in Example 1.

(3) Preparation of Laminate

The heat transfer sheet and the image-receiving sheet material prepared as above were passed through heat rollers each having a surface temperature of 70° C. under a pressure of 4.5 kg/cm$^2$ and at a speed of 200 cm/min to produce a laminate. As a result, the image receiving layer and the heat transferable ink layer came into substantially uniform contact with each other. The laminating pressure was measured using a pressure-sensitive color forming material (prescale) for measuring pressure produced by Fuji Photo Film Co., Ltd. by passing the material through rollers at room temperature.

(4) The thus-obtained laminate was wound around a rotary drum having an opened suction hole for vacuum adsorption so that the heat transfer sheet support and the image-receiving sheet material support were put into contact with a laser beam entering surface and the rotary drum surface, respectively, and fixed in place under vacuum. Semiconductor laser beams having a wavelength of 830 nm were focused on the light-heat conversion layer as a spot of 8 μm, and the laser beams were modulated according to the recording image while moving (secondary scanning) in the direction perpendicular to the rotating direction (main scanning direction) of the rotary drum. The conditions for the laser recording were as follows.

| | |
|---|---|
| Laser power | 100 mW |
| Main scanning speed | 8 m/sec |
| Secondary scanning pitch (secondary scanning amount per one rotation) | 5 μm |

(5) After the recording, the laminate was removed from the drum and the image-receiving sheet material and the heat transfer sheet were manually peeled apart. As a result, it was clearly observed that the image forming layer only at the part irradiated by laser beams was transferred to the image-receiving layer. Furthermore, when the transferred image was observed through an optical microscope, dots of 200 lines/inch were reproduced in a range of from 3 to 98%. The dot shape was also good.

By using an image-receiving sheet material, a transfer image formation method and a laminate according to the present invention, an image is provided which has good recording sensitivity, dot quality (halftone dot shape) and gradation reproducibility (halftone dot reproducibility). Furthermore, the material is not tacky, and is free from sticking and dust flaws. Moreover, the recording sensitivity to changes in humidity is reduced, and good printed matter approximation is obtained.

While the invention has been described in detail and with reference to specific examples, it will be apparent to one skilled in the art that various changes and modifications can be made without departing from the spirit and scope thereof.

What is claimed is:

1. An image-receiving sheet material for use in forming a transfer image by heat-transferring an ink layer from a transfer material having a heat-transferable ink layer onto an image-receiving sheet material and then re-transferring the ink layer onto a permanent support, wherein:

said image-receiving sheet material comprises a support having thereon at least two image-receiving layers;

at least one of said image-receiving layers is transferred onto the permanent support; and at least the image-receiving layer onto which said ink layer is transferred comprises a modified polyvinyl acetal resin prepared from a polyvinyl acetal resin containing hydroxyl groups in which from 0.1 to 1 equivalent of the hydroxyl groups have been converted to a group represented by the following formula (I):

—O—W (I)

wherein W represents —CONH—$Y^1$, —COO—$Y^2$, —$Y^3$, —$SiY^4Y^5Y^6$, $SO_2Y^7$, —CO—$Z^1$—COOH or —$COCH_2COMe$, $Y^1$, $Y^2$, $Y^3$, $Y^4$, $Y^5$, $Y^6$ and $Y^7$ each represents a monovalent organic group having from 1 to 20 carbon atoms and $Z^1$ represents a divalent organic group having from 1 to 20 carbon atoms.

2. The image-receiving sheet as claimed in claim 1, wherein at least said image-receiving layer, onto which said ink layer is transferred, of said at least two image receiving layers further comprises a high molecular weight compound having at least one repeating unit represented by the following formula (II) and formula (III):

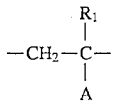

(II)

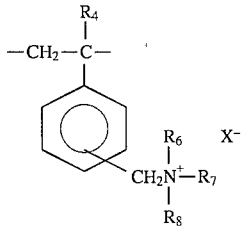

(III)

wherein $R_1$ represents a hydrogen atom or a methyl group, A represents a substituent having an amido bond or a nitrogen-containing heterocyclic ring, $R_4$ represents a hydrogen atom or a methyl group, $R_6$, $R_7$ and $R_8$ may be the same or different and each represents a substituted or unsubstituted alkyl group having from 1 to 25 carbon atoms, a substituted or unsubstituted aralkyl group having from 7 to 25 carbon atoms or a substituted or unsubstituted aryl group having from 6 to 25 carbon atoms, and X represents Cl, Br or I.

3. The image-receiving sheet material as claimed in claim 1, wherein said modified polyvinyl acetal resin is an adduct of a polyvinyl acetal resin with a monofunctional isocyanate.

4. The image-receiving sheet material as claimed in claim 2, wherein said modified polyvinyl acetal resin is an adduct of a polyvinyl acetal resin with a monofunctional isocyanate.

5. The image-receiving sheet material as claimed in claim 1, wherein said polyvinyl acetal resin is polyvinyl butyral.

6. The image-receiving sheet material as claimed in claim 2, wherein said polyvinyl acetal resin is polyvinyl butyral.

7. The image-receiving sheet material as claimed in claim 3, wherein said polyvinyl acetal resin is polyvinyl butyral.

8. The image-receiving sheet material as claimed in claim 4, wherein said polyvinyl acetyl resin is polyvinyl butyral.

9. The image-receiving sheet material as claimed in claim 2, wherein the alkyl group, the aralkyl group and the aryl group represented by $R_6$, $R_7$ and $R_8$ are unsubstituted.

10. The image-receiving sheet material as claimed in claim 2, wherein one or more of the alkyl group, the aralkyl group and the aryl group represented by $R_6$, $R_7$ and $R_8$ are substituted by a hydroxyl group, an alkoxy group having from 1 to 6 carbon atoms, a halogen group, a cyano group or a combination of two or more of these groups either directly or via an ether bond, —OCO—, —COO— or a combination of two or more of these groups.

11. The image-receiving sheet material as claimed in claim 1, wherein said image-receiving sheet material comprises first and second image-receiving layers, said first image-receiving layer is arranged between the support of the image-receiving sheet and the second image-receiving layer, and the first image-receiving layer has a modulus of the elasticity of 200 kg.f/$cm^2$ or less.

12. The image-receiving sheet material as claimed in claim 11, wherein said first image-receiving layer has a thickness from 1 to 50 μm.

13. The image-receiving sheet material as claimed in claim 1, wherein the image receiving layer onto which the ink layer is transferred comprises a modified polyvinyl acetal resin in an amount of 40 wt % or more based on the total solid content of the layer.

14. The image-receiving sheet material as claimed in claim 2, wherein the content of the high molecular weight compound having at least one repeating unit represented by formulae (II) and (III) is from 5 to 40 wt % based on the total solid content of the image-receiving layer onto which the ink layer is transferred.

15. The image-receiving sheet material as claimed in claim 11, wherein the second image-receiving layer has a thickness of from 0.1 to 10 μm.

16. A method for forming a transfer image comprising:

providing a support having thereon a heat-transferable ink layer, and an image-receiving sheet material, wherein:

said heat-transferable ink layer comprises a pigment and a noncrystalline organic polymer binder; and said image-receiving sheet material comprises a support having thereon at least two image-receiving layers and at least the image-receiving layer onto which said ink layer is transferred comprises a modified polyvinyl acetal resin prepared from a polyvinyl acetal resin containing hydroxyl groups in which from 0.1 to 1 equivalent of the hydroxyl groups have been converted to a group represented by the following formula (I):

—O—W (I)

wherein W represents —CONH—$Y^1$, —COO—$Y^2$, —$Y^3$, —$SiY^4Y^5Y^6$, $SO_2Y^7$, —CO—$Z^1$—COOH or —$COCH_2COMe$, $Y^1$, $Y^2$, $Y^3$, $Y^4$, $Y^5$, $Y^6$ and $Y^7$ each represents a monovalent organic group having from 1 to 20 carbon atoms and $Z^1$ represents a divalent organic group having from 1 to 20 carbon atoms;

bringing said heat-transferable ink layer into contact with said image-receiving sheet material;

heat transferring said ink layer onto said image-receiving sheet material to form an ink image; and then transferring said ink image and at least one of the image-receiving layers onto a permanent support.

17. The method for forming a transfer image as claimed in claim 16, wherein said heat-transferable ink layer contains said pigment in an amount of from 30 to 70 parts by weight and said noncrystalline organic polymer binder in an amount of from 25 to 60 parts by weight per 100 parts by weight of the ink layer.

18. The method for forming a transfer image as claimed in claim 16, wherein said noncrystalline organic polymer binder has a softening point of from 50° to 150° C.

19. The method for forming a transfer image as claimed in claim 16, wherein said heat-transferable ink layer has a thickness of from 0.2 to 1.0 μm.

20. The method for forming a transfer image as claimed in claim 16, wherein at least said image receiving layer, onto which said ink layer is transferred, of said at least two image receiving layers further comprises a high molecular weight compound having at least one repeating unit represented by the following formula (II) and formula (III):

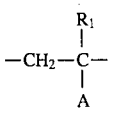

(II)

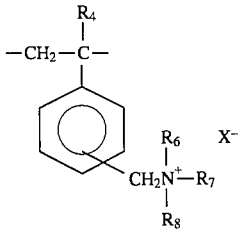

(III)

wherein $R^1$ represents a hydrogen atom or a methyl group, A represents a substituent having an amido bond or a nitrogen-containing heterocyclic ring, $R_4$ represents a hydrogen atom or a methyl group, $R_6$, $R_7$ and $R_8$ may be the same or different and each represents a substituted or unsubstituted alkyl group having from 1 to 25 carbon atoms, a substituted or unsubstituted aralkyl group having from 7 to 25 carbon atoms or a substituted or unsubstituted aryl group having from 6 to 25 carbon atoms, and X represents Cl, Br or I.

21. The method as claimed in claim 20, wherein the alkyl group, the aralkyl group and the aryl group represented by $R_6$, $R_7$ and $R_8$ are unsubstituted.

22. The method as claimed in claim 20, wherein one or more of the alkyl group, the aralkyl group and the aryl group represented by $R_6$, $R_7$ and $R_8$ are substituted by a hydroxyl group, an alkoxy group having from 1 to 6 carbon atoms, a halogen atom, a cyano group or a combination of two or more of these groups either directly or via an ether bond, —OCO—, —COO— or a combination of two or more of these groups.

23. A laminate which comprises:

an image receiving material comprising a support having thereon at least two image receiving layers; and having transferred thereon a transfer material comprising a support having thereon a heat-transferable ink layer, said heat-transferable ink layer being adhered to said image receiving layer, wherein said heat-transferable ink layer comprises a pigment and a noncrystalline organic polymer binder, and at least the image-receiving layer onto which said ink layer is transferred comprises a modified polyvinyl acetal resin prepared from a polyvinyl acetal resin containing hydroxyl groups in which from 0.1 to 1 equivalent of the hydroxyl groups have been converted to a group represented by the following formula (I):

$$-O-W \qquad (I)$$

wherein W represents —CONH—$Y^1$, —COO—$Y^2$, —$Y^3$, —$SiY^4Y^5Y^6$, $SO_2Y^7$, —CO—$Z^1$—COOH or —$COCH_2COMe$, $Y^1$, $Y^2$, $Y^3$, $Y^4$, $Y^5$, $Y^6$ and $Y^7$ each represents a monovalent organic group having from 1 to 20 carbon atoms and $Z^1$ represents a divalent organic group having from 1 to 20 carbon atoms.

24. The laminate as claimed in claim 23, wherein said heat-transferable ink layer contains said pigment in an amount of from 30 to 70 parts by weight and said noncrystalline organic polymer binder in an amount of from 25 to 60 parts by weight per 100 parts by weight of the ink layer.

25. The laminate as claimed in claim 23, wherein said noncrystalline organic polymer binder has a softening point of from 50° to 150° C.

26. The laminate as claimed in claim 23, wherein said heat-transferable ink layer has a thickness of from 0.2 to 1.0 μm.

27. The laminate as claimed in claim 23, wherein at least said image receiving layer, onto which said ink layer is transferred, of said at least two image receiving layers further comprises a high molecular weight compound having at least one repeating unit represented by the following formula (II) and formula (III):

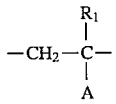

(II)

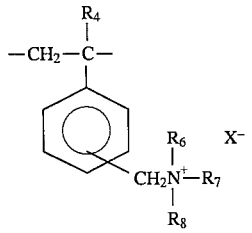

(III)

wherein $R_1$ represents a hydrogen atom or a methyl group, A represents a substituent having an amido bond or a nitrogen-containing heterocyclic ring, $R_4$ represents a hydrogen atom or a methyl group, $R_6$, $R_7$ and $R_8$ may be the same or different and each represents a substituted or unsubstituted alkyl group having from 1 to 25 carbon atoms, a substituted or unsubstituted aralkyl group having from 7 to 25 carbon atoms or a substituted or unsubstituted aryl group having from 6 to 25 carbon atoms, and X represents Cl, Br or I.

28. The laminate as claimed in claim 27, wherein the alkyl group, the aralkyl group and the aryl group represented by $R_6$, $R_7$ and $R_8$ are unsubstituted.

29. The laminate as claimed in claim 27, wherein one or more of the alkyl group, the aralkyl group and the aryl group represented by $R_6$, $R_7$ and $R_8$ are substituted by a hydroxyl group, an alkoxy group having from 1 to 6 carbon atoms, a halogen atom, a cyano group or a combination of two or more of these groups either directly or via an ether bond, —OCO—, —COO— or a combination of two or more of these groups.

* * * * *